US011568842B2

(12) United States Patent
Asano et al.

(10) Patent No.: US 11,568,842 B2
(45) Date of Patent: Jan. 31, 2023

(54) DRUMSTICK

(71) Applicant: ASANO MOKKO SHO, LTD., Aichi (JP)

(72) Inventors: Junichi Asano, Aichi (JP); Toshihiko Torii, Nakatsugawa (JP)

(73) Assignee: ASANO MOKKO SHO, LTD., Aichi (JP)

( * ) Notice: Subject to any disclaimer, the term of this patent is extended or adjusted under 35 U.S.C. 154(b) by 0 days.

(21) Appl. No.: 17/526,744

(22) Filed: Nov. 15, 2021

(65) Prior Publication Data

US 2022/0215817 A1 Jul. 7, 2022

(30) Foreign Application Priority Data

Jan. 6, 2021 (JP) ..... JP2021-864

(51) Int. Cl.
*G10D 13/12* (2020.01)

(52) U.S. Cl.
CPC ..... *G10D 13/12* (2020.02)

(58) Field of Classification Search
CPC ..... G10D 13/12
See application file for complete search history.

(56) References Cited

U.S. PATENT DOCUMENTS 3,301,119 A * 1/1967 Gilbert ..... G10D 13/12 984/150
3,489,052 A * 1/1970 Colyer ..... G10D 13/12 984/150
3,722,350 A * 3/1973 Cordes ..... G10D 13/12 984/150
3,958,485 A * 5/1976 Peters ..... G10D 13/12 984/150
4,320,688 A * 3/1982 Donohoe ..... G10D 13/12 984/150
4,385,544 A * 5/1983 Heiskell ..... G10D 13/12 984/150
5,179,237 A 1/1993 Grossman
5,218,152 A * 6/1993 Campbell ..... G10D 13/12 84/422.4
5,503,056 A * 4/1996 Evans ..... G10D 13/12 84/422.4
7,538,264 B1 * 5/2009 Turos ..... G10D 13/12 84/422.4

(Continued)

FOREIGN PATENT DOCUMENTS

CN 109147735 A 1/2019
EP 36439 A * 9/1981 ..... A61K 8/65

(Continued)

*Primary Examiner* — Robert W Horn
(74) *Attorney, Agent, or Firm* — WHDA, LLP

(57) ABSTRACT

Provided is a drumstick being excellent in durability and enabling a drum performer to achieve a more sensitive performance with vibration transmitted to the drumstick. A drumstick includes: a first rod-like portion, which is made of a synthetic resin, and includes a tip and a shoulder; and a second rod-like portion, which is coupled to the first rod-like portion, and includes a grip, wherein the first rod-like portion has a cavity defined therein so as to extend along an axial direction and over an entire length of the first rod-like portion, and wherein the cavity is open to an outside at an opening portion formed at a distal end of the tip.

6 Claims, 4 Drawing Sheets

(56) References Cited

U.S. PATENT DOCUMENTS

| | | | | |
|---|---|---|---|---|
| 7,855,332 | B1 * | 12/2010 | Turos | G10D 13/12 84/422.4 |
| 7,868,237 | B1 * | 1/2011 | Quilon | G10D 13/12 84/422.4 |
| 10,269,333 | B1 | 4/2019 | Vater et al. | |
| 10,482,854 | B1 * | 11/2019 | Freer | G10D 13/12 |
| 2004/0244563 | A1 | 12/2004 | Calato | |
| 2009/0084247 | A1 * | 4/2009 | Rundle | G10D 13/12 84/422.4 |
| 2014/0311320 | A1 | 10/2014 | Grossman | |
| 2020/0265814 | A1 | 8/2020 | Mayo | |

FOREIGN PATENT DOCUMENTS

| | | | | |
|---|---|---|---|---|
| JP | 3-71392 | U | 7/1991 | |
| JP | 9-114452 | A | 5/1997 | |
| WO | WO-03005338 | A1 * | 1/2003 | G10D 13/003 |

* cited by examiner

DRUMSTICK

BACKGROUND OF THE INVENTION

1. Field of the Invention

The present invention relates to a drumstick for beating a drum or a cymbal for a performance.

2. Description of the Related Art

Drumsticks which have hitherto been available on the main stream are made of wood such as hickory, maple, or oak. However, the drumsticks made of wood have a problem in that splinters are formed due to use over time, and such problem may cause scattering of wood chips. As a result, it may be troublesome to clean out wood chips that fall on a floor of a stage. Further, wood is a natural object, and hence directions and intensities of fibers are not uniform. Thus, there is a problem in that cracks may be suddenly formed and cause breakage of the drumstick. Accordingly, in general, a drum performer assumes in advance that drumsticks are to be broken, and thus owns a plurality of spare drumsticks. Further, there is also a problem in that the drumsticks made of wood may be bent due to humidity. Further, a gravity center of the drumstick made of wood is determined based on a length, a thickness, and the like of the drumstick itself. Thus, gravity centers of drumsticks having the same length and thickness cannot be controlled.

In view of such problems, in recent years, drumsticks made of a synthetic resin are proposed (for example, Japanese Patent Application Laid-open No. 09-114452). Formation of splinters due to use over time does not occur in the drumsticks made of a synthetic resin. Further, the drumsticks made of a synthetic resin are significantly improved in durability as compared to the drumsticks made of wood, and are not bent due to humidity. Further, wood is not consumed, and hence environmental destruction can be prevented.

Meanwhile, in some cases, at the time of performing a musical piece, a drum performer can scarcely hear a sound of own musical instrument being performed on due to sounds of other musical instruments and cheers of audiences. Thus, many drum performers perform while listening to click sounds generated by a metronome with a headphone or the like. Accordingly, even when other musical instruments or cheers of audiences are present, a drum performer can perform on the drum with an appropriate rhythmical sense, thereby being capable of stabilizing a rhythm during the performance.

Further, under the circumstance in which the drum performer can scarcely hear the sound of the own musical instrument being performed on, the drum performer grasps and controls the sound of the own musical instrument being performed on by relying on, in addition to the click sounds, vibration transmitted to hands at the time of beating the drum. That is, in order to maximally exert the performance, the vibration transmitted to hands at the time of beating with drumsticks is important. Thus, in order to achieve a wider variety of tones and expressions of sounds, it is required that the vibration transmitted to hands and the sound generated from the drum at the time of beating with the drumsticks stably match each other, and it is preferred that drumstick be excellent in transmission of the vibration.

However, the drumsticks made of a synthetic resin which are widely available in recent years have a high hardness because a synthetic resin is used as a material, and may generate sharp sounds which are not intended by a drum performer, depending on a way of beating the drum. The drumsticks made of a synthetic resin are excellent in terms of durability and a change in condition due to humidity, and hence there are certain needs for such drumsticks. However, due to the difficulty in handling, it is required that the vibration be felt more finely in order to achieve the quality of the sound played by a drum performer. Further, the related-art drumsticks are not accurate in transmission of the vibration, and a sensitive performance cannot be achieved. Thus, a drum performer is required to prepare toms having different sizes and drumsticks having different thicknesses or the like and use different toms and drumsticks depending on musical pieces to be performed.

SUMMARY OF THE INVENTION

The present invention has been made in view of such problems, and has an object to provide a drumstick enabling a drum performer to achieve a more sensitive performance with vibration transmitted to the drumstick, being excellent in durability, and further being capable of expressing various tones without need for preparation of a plurality of toms and drumsticks.

That is, according to the present invention, there is provided a drumstick for a performance, including: a first rod-like portion, which is made of a synthetic resin, and includes a tip and a shoulder; and a second rod-like portion, which is coupled to the first rod-like portion, and includes a grip, wherein the first rod-like portion has a cavity defined therein so as to extend along an axial direction and over an entire length of the first rod-like portion, and the cavity is open to an outside at an opening portion formed at a distal end of the tip.

According to the drumstick of the present invention, a resonance frequency generated at the time of beating with the drumstick can be controlled by suitably changing a shape and a size of the cavity defined in the first rod-like portion. Accordingly, the vibration transmitted to a hand via the drumstick and the sound generated from the drum can match each other. Thus, even when a drum is performed on under a circumstance in which the sound of the own musical instrument cannot be heard, a more sensitive performance can be achieved.

Further, the sensitive performance can be achieved, and hence it becomes easier for a drum performer to make changes in strength at the time of beating toms and cymbals, thereby being capable of widening a range of tones and a dynamic range without preparing toms having different sizes and drumsticks having different thicknesses or the like.

Further, the gravity center of the drumstick itself can be controlled by changing a shape and a size of the cavity defined in the first rod-like portion. Accordingly, a drum performer can select a drumstick that suits the own preference, thereby being capable of achieving a more sensitive performance.

DESCRIPTION OF THE EMBODIMENTS

Now, a drumstick according to the present invention is described in detail with reference to the accompanying drawings.

Figure 1:
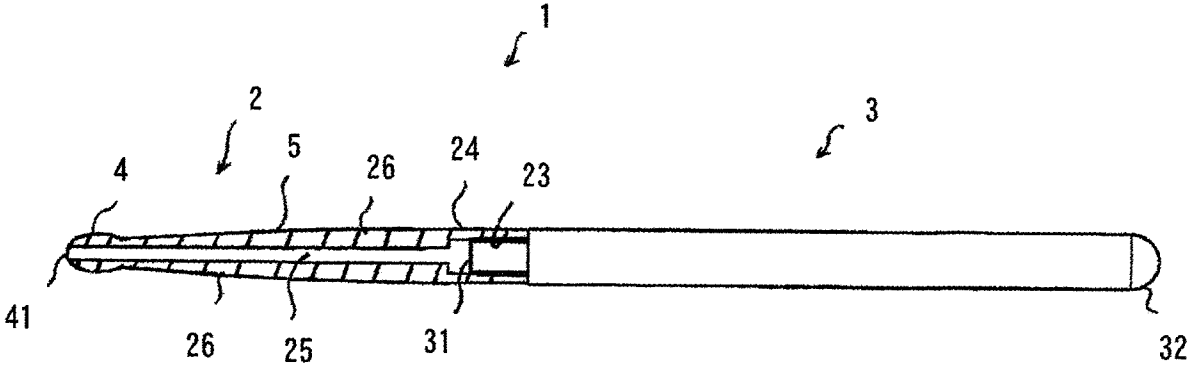
FIG. 1 is an overall view for illustrating a drumstick according to a first embodiment of the present invention.

FIG. 1 is an overall view for illustrating a drumstick according to a first embodiment of the present invention. The drumstick 1 is to be used at the time of beating a drum or a cymbal. The drumstick 1 is formed of a first rod-like portion 2 and a second rod-like portion 3 coupled to the first rod-like portion 2. In FIG. 1, the first rod-like portion 2 is illustrated in a sectional view. In this embodiment, the first rod-like portion 2 and the second rod-like portion 3 are coupled to each other with an adhesive. However, a change in design may be suitably adopted as long as the first rod-like portion 2 and the second rod-like portion 3 are firmly coupled to each other, for example, by coupling with a pin.

The first rod-like portion 2 is made of a synthetic resin material. Thus, the first rod-like portion 2 is higher in durability and less liable to be broken as compared to a case in which the drumstick 1 is made of wood. The first rod-like portion 2 of this embodiment is produced by injection molding with a mold.

The first rod-like portion 2 is formed of a tip 4, a shoulder 5, and a coupling portion 24, which are formed so as to be continuous with each other. The shoulder 5 has a conical shape that expands as extending toward a rear end side of the first rod-like portion 2. The tip 4 having an opening portion 41 is provided at a distal end portion of the shoulder 5. That is, the tip 4 is provided at the most distal end of the first rod-like portion 2. The tip 4 is formed as a substantially spherical body, and is to be used as a beating part at the time of performing on the drum. Thus, the sound of the drum can be played by beating a batter head of the drum with the tip 4. The shape of the tip 4 may be suitably changed in design, for example, to a circular shape, a rectangular shape, a tear-drop shape, a triangular shape, or a tipless form.

Further, on the rear end side of the first rod-like portion 2, there is provided the coupling portion 24 that continues to a rear end side of the shoulder 5. The coupling portion 24 has a fitting hole 23 for coupling the second rod-like portion 3.

The first rod-like portion 2 has a cavity 25 defined therein. The cavity 25 has an inner diameter that is uniform along an axial direction of the first rod-like portion 2. The cavity 25 is open to an outside at the opening portion 41 formed at the distal end of the tip 4. Meanwhile, a rear end portion of the cavity 25 communicates with the fitting hole 23 for coupling the first rod-like portion 2 and the second rod-like portion 3 to each other. With the presence of the cavity 25, air inside the cavity 25 serves as a spring to induce aerial vibration at the time of beating the drum. Thus, resonance of an air column is controlled through suitable adjustment of a length, a sectional area, a volume, and an inner diameter of the cavity 25 so that the aerial vibration can resonate at a predetermined frequency. The cavity 25 is molded with a slide pin provided in the mold at the time of the injection molding. The shape of the cavity 25 is not particularly limited as long as the cavity 25 communicates with the opening portion 41 formed in the tip 4, and may be any other shape, for example, a tapered shape having an inner diameter that gradually increases.

The second rod-like portion 3 is coupled to the first rod-like portion 2 at the coupling portion 24. The second rod-like portion 3 is made of wood such as hickory, maple, or oak. The second rod-like portion 3 includes a grip, and thus serves as a holding part of the drumstick 1. At the most rear end of the second rod-like portion 3, a grip end cap 32 is provided. A circular protrusion 31 is provided at a distal end of the second rod-like portion 3. The circular protrusion 31 is inserted into the fitting hole 23 of the first rod-like portion 2. The second rod-like portion 3 is made of wood in this embodiment, but may be made of a synthetic resin.

Figure 2:
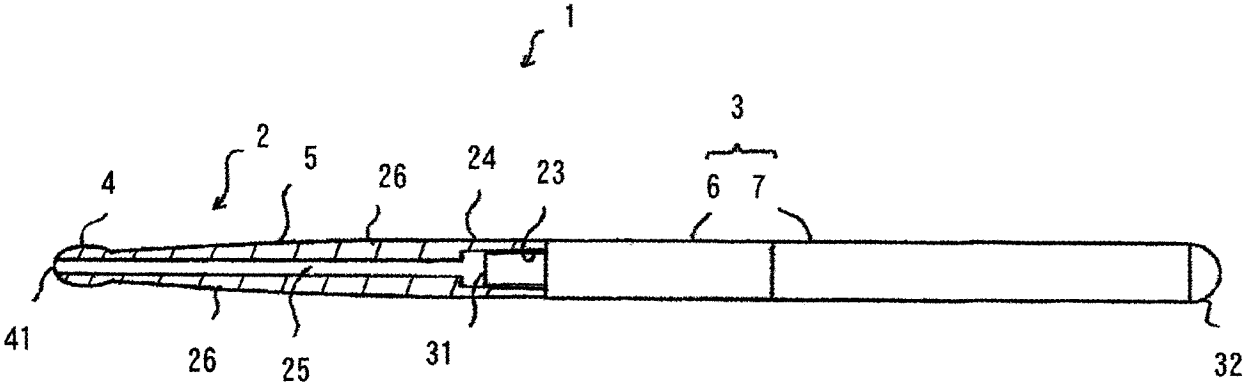
FIG. 2 is an overall view for illustrating a modification example of the first embodiment.

Further, as illustrated in FIG. 2, the second rod-like portion 3 may be formed of an intermediate rod-like portion 6 and a grip 7. The intermediate rod-like portion 6 is made of wood such as hickory, maple, or oak. The intermediate rod-like portion 6 is provided on the distal end side of the second rod-like portion 3. At a distal end of the intermediate rod-like portion 6, the circular protrusion 31 is provided. Similarly to the example of FIG. 1, the circular protrusion 31 is inserted into the fitting hole 23 of the first rod-like portion 2. The intermediate rod-like portion 6 and the first rod-like portion 2 are coupled to each other with, for example, an adhesive. The intermediate rod-like portion 6 can generate a soft sound similarly to a drumstick made of wood when it is used at the time of performing a rim-shot.

The grip 7 is made of a synthetic resin. The grip 7 is provided at the rear end of the second rod-like portion 3. At the most rear end of the grip 7, a grip end cap 32 is provided. The grip 7 and the intermediate rod-like portion 6 are coupled to each other with, for example, an adhesive. In the drumstick 1, the first rod-like portion 2 and the grip 7 are made of a synthetic resin, and the intermediate rod-like portion 6 is made of wood. Thus, a synthetic resin part occupies a large proportion in the overall configuration of the drumstick 1. Accordingly, when the second rod-like portion 3 is formed of the intermediate rod-like portion 6 and the grip 7, consumption of a wood material to be used for forming the drumstick can be minimized.

Next, a method of use of the drumstick 1 according to the first embodiment is described.

At the time of performing on a drum set using the drumstick 1, the second rod-like portion 3 is gripped with a hand, and a face of a drum is beaten with the tip 4 of the drumstick 1.

When the drum is beaten with the drumstick 1, vibration is generated from the tip 4 beating the drum. The drumstick 1 has the cavity 25 defined in the first rod-like portion 2. Thus, when the vibration is generated in the drumstick 1, air column resonance occurs in the cavity 25. When the air column resonance occurs, the vibration is amplified by a resonance phenomenon that occurs in the cavity 25, thereby vibrating the entire drumstick 1. That is, in accordance with the strength of the force of beating the drum during a performance of a musical piece, the drumstick 1 allows the aerial vibration amplified by the air column resonance to be transmitted to the hand via the second rod-like portion 3.

The resonance of the air column can be controlled through suitable adjustment of a length, a sectional area, a volume, and an inner diameter of the cavity 25. Thus, the resonance frequency of the aerial vibration can be adjusted in accordance with, for example, the preference of a drum performer, a musical piece, and a tension strength of the drum face. Accordingly, the drum performer can feel the vibration more finely through use of such a drumstick that the vibration at a resonance frequency tuned in accordance with the own preference and a musical piece can be felt at a hand. Consequently, a drum performer can select such a drumstick that the sound generated from the musical instrument and the vibration transmitted to a hand at the time of beating with the drumstick match each other, from among a plurality of drumsticks having an adjusted resonance frequency.

As described above, according to the drumstick 1 of the first embodiment of the present invention, even under a circumstance in which the sound of the own musical instrument being performed on cannot be heard, with the sound generated from the musical instrument and the vibration transmitted to a hand at the time of beating with the drumstick matching each other, a drum performer can accurately grasp the sound played with the own musical instrument being performed on through the vibration transmitted to the hand at the time of beating, thereby being capable of stably achieving the performance and achieving a more sensitive performance.

Further, according to the drumstick 1 of this embodiment, a more sensitive performance can be achieved as compared to a normal drumstick. Thus, it is easy for a drum performer to make changes in strength at the time of beating toms or cymbals, thereby being capable of expressing various tones with one drumstick and widening a dynamic range. Accordingly, the drum performer can express various tones without increasing kinds of toms having different sizes and drumsticks having different thicknesses or the like.

Further, through suitable adjustment of the shape of the cavity 25 defined in the drumstick 1, the gravity center of the entire drumstick can be controlled, while it has been difficult to control the gravity center of a drumstick made of wood. Accordingly, a drum performer can select a drumstick having a gravity center that suits the own preference, thereby being capable of achieving a more sensitive performance.

Next, a drumstick according to a second embodiment of the present invention is described.

Figure 3:
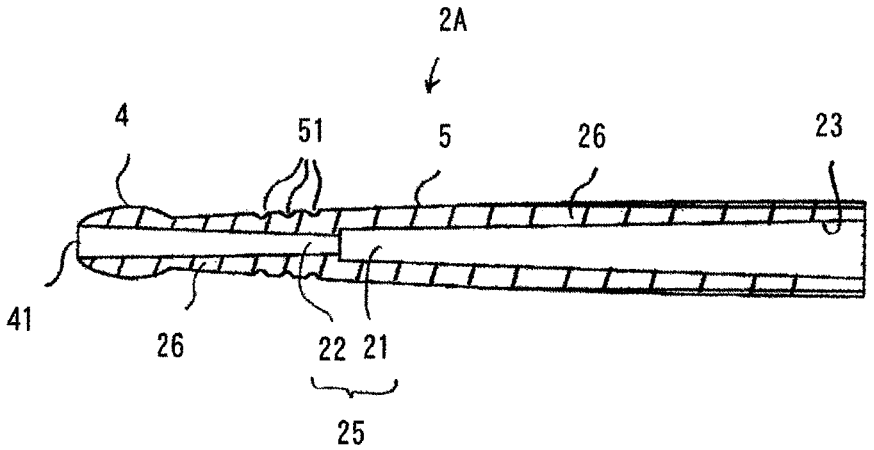
FIG. 3 is a sectional view for illustrating a first rod-like portion of a drumstick according to a second embodiment of the present invention.
Figure 4:
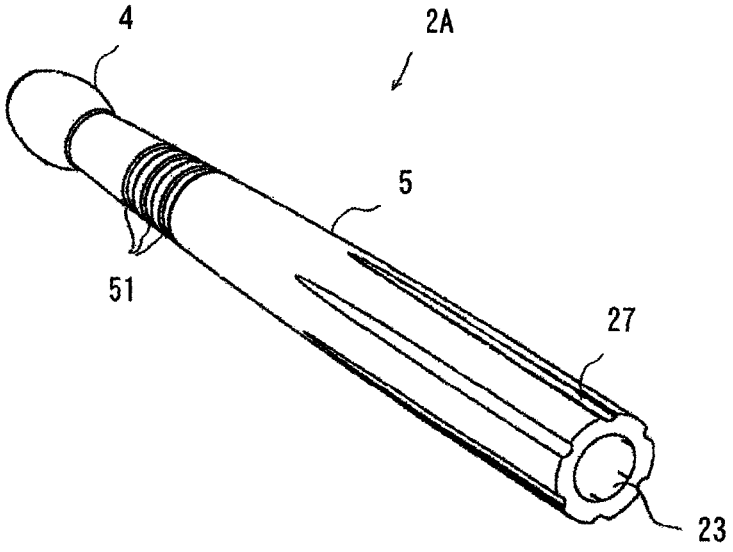
FIG. 4 is a perspective view of the first rod-like portion illustrated in FIG. 3.

FIG. 3 and FIG. 4 are views for illustrating a first rod-like portion 2A of a drumstick 1 according to the second embodiment. FIG. 3 is a sectional view, and FIG. 4 is a perspective view. Similarly to the drumstick 1 according to the first embodiment, the first rod-like portion 2A is coupled to the distal end of the second rod-like portion 3 for use.

The first rod-like portion 2A is formed of the tip 4, the shoulder 5, and the coupling portion 24, which are formed so as to be continuous with each other. Basic configurations are the same as those of the first embodiment. Thus, the components are denoted by the same reference symbols in FIG. 3 and FIG. 4, and only differences are described here.

Shoulder grooves 51 are formed around a distal end of the shoulder 5. The shoulder grooves 51 are each formed in an annular shape along a circumferential direction of the first rod-like portion 2A. In this embodiment, three shoulder grooves 51 are arrayed at intervals along an axial direction of the first rod-like portion 2A. Accordingly, at the time of beating with the drumstick 1, flexure can be promoted at the shoulder grooves 51 so that vibration is likely to be generated.

On the rear end side of the shoulder 5, a plurality of straight reinforcement grooves 27 extending along the axial direction of the first rod-like portion 2A are formed. The reinforcement grooves 27 are formed at equal intervals along the circumferential direction of the first rod-like portion 2A. The reinforcement grooves 27 are formed so as to extend from the coupling portion 24 to the shoulder 5. Accordingly, the strength of the shoulder 5 against the flexure can be increased, thereby being capable of promoting transmission of the vibration generated at the time of beating with the drumstick 1.

The first rod-like portion 2A has the cavity 25 defined therein. The cavity 25 is formed of an inlet cavity portion 22 formed on the distal end side and a resonance cavity portion 21 formed on the rear end side. The inlet cavity portion 22 is formed on the distal end side of the first rod-like portion 2A. The inlet cavity portion 22 is open to an outside through the opening portion 41 formed at the distal end of the tip 4. The inlet cavity portion 22 is a cavity that is smaller in overall length and smaller in size than the resonance cavity portion 21. The inlet cavity portion 22 has a tapered shape. That is, an internal space of the inlet cavity portion 22 is gradually expanded as extending toward the distal end side of the first rod-like portion 2A. When the inlet cavity portion 22 has a tapered shape, a peripheral wall 26 of the shoulder 5 can have a uniform thickness. Accordingly, the strength of the drumstick can be maintained.

The resonance cavity portion 21 is formed on the rear end side of the first rod-like portion 2A. The resonance cavity portion 21 has an inner diameter larger than that of the inlet cavity portion 22. The resonance cavity portion 21 has a tapered shape. That is, an internal space of the resonance cavity portion 21 gradually expands as extending toward the rear end side of the first rod-like portion 2A. Further, the resonance cavity portion 21 is closed by the circular protrusion 31 of the second rod-like portion 3 inserted into the fitting hole 23 of the first rod-like portion 2A. When the resonance cavity portion 21 also has a tapered shape, the peripheral wall 26 of the shoulder 5 can have a uniform thickness. Also in the second embodiment, with the presence of the cavity 25, air inside the cavity 25 serves as a spring to induce aerial vibration at the time of beating the drum.

A configuration of the second rod-like portion 3 is the same as that of the first embodiment. Thus, components are denoted by the same reference symbols, and detailed description thereof is omitted here.

Next, a method of use of the drumstick 1 according to the second embodiment is described.

At the time of performing on a drum set using the drumstick 1, similarly to the drumstick 1 according to the first embodiment, the second rod-like portion 3 is gripped with a hand, and a face of a drum is beaten with the tip 4.

Similarly to the drumstick according to the first embodiment, when the drum is beaten with the drumstick 1, air inside the cavity 25 vibrates to resonate. In the drumstick 1, the internal space of the resonance cavity portion 21 is larger than the internal space of the inlet cavity portion 22. Thus, aerial vibration generated in the cavity 25 becomes larger. That is, the drumstick 1 causes a Helmholtz resonance when the air column resonance in the cavity 25 is induced. Accordingly, as compared to a case in which the cavity 25 has a straight cavity, the amount of amplification of the aerial vibration in the cavity 25 becomes larger.

Also in the second embodiment, the resonance frequency can be controlled through suitable adjustment of a length, a sectional area, a volume, and an inner diameter of each of the inlet cavity portion 22 and the resonance cavity portion 21. Consequently, a drum performer can select such a drumstick that the sound generated from the musical instrument and the vibration transmitted to a hand at the time of beating with the drumstick match each other, from among a plurality of drumsticks having an adjusted resonance frequency, and perform on the drum using the drumstick.

Further, the shoulder grooves 51 for promoting generation of vibration are formed on the distal end side of the shoulder 5, and the reinforcement grooves 27 for promoting transmission of the vibration are formed on the rear end side of the shoulder 5. With such configuration, at the time of beating with the tip 4, the shoulder grooves 51 allow the distal end part of the drumstick to be likely to vibrate. Further, the rear end side of the shoulder 5 to which the vibration is transmitted has durability against the flexure owing to the reinforcement grooves 27 formed in the shoulder 5, thereby maintaining the vibration and further transmitting the vibration to the second rod-like portion 3. Accordingly, with the presence of the shoulder grooves 51 and the reinforcement grooves 27, the vibration generated at the time of beating with the drumstick 1 can easily be felt.

As described above, according to the drumstick 1 of the second embodiment of the present invention, the aerial vibration can be amplified by occurrence of the Helmholtz resonance, and the transmission of the vibration can be promoted with the shoulder grooves 51 and the reinforcement grooves 27. Accordingly, the vibration transmitted to a hand at the time of beating with the drumstick can easily be felt, thereby enabling a more sensitive performance.

Further, according to the drumstick 1 of this embodiment, a more sensitive performance can be achieved as compared to a normal drumstick. Thus, various tones can be expressed with one drumstick and a dynamic range can be widened. Accordingly, the drum performer can express various tones without preparing toms having different sizes and drumsticks having different thicknesses or the like.

Figure 5:
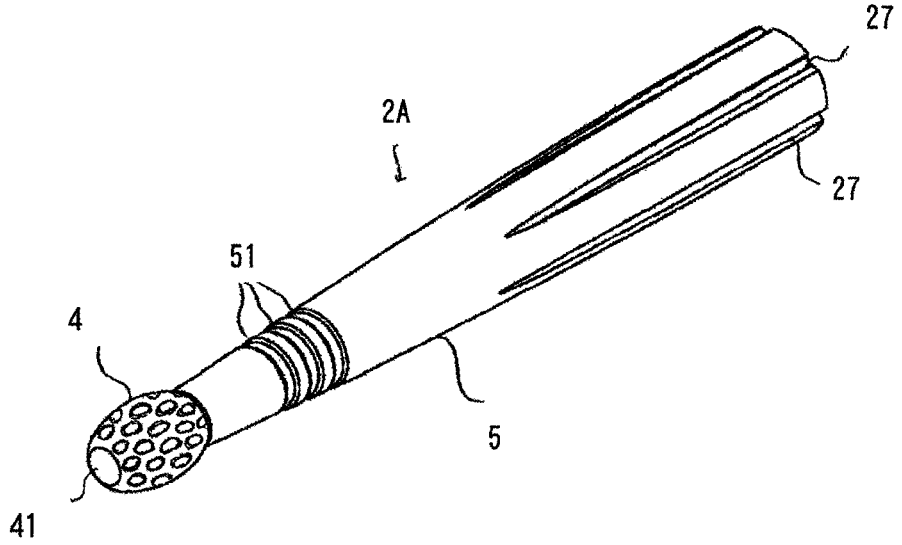
FIG. 5 is a perspective view for illustrating a modification example of the first rod-like portion of the second embodiment.

Further, as illustrated in FIG. 5, dimples may be formed in an outer peripheral surface of the tip 4. With such configuration, even in a case of a drumstick including the tip 4 made of a synthetic resin, a soft sound can be generated similarly to a drumstick made of wood.

What is claimed is:

1. A drumstick for a performance, comprising:

a first rod-like portion, which is made of a synthetic resin, and includes a tip, a shoulder, and a coupling portion, which are formed so as to be continuous with each other; and a second rod-like portion, which is coupled to the first rod-like portion through intermediation of the coupling portion, and includes a grip, wherein the first rod-like portion has a cavity defined therein so as to extend along an axial direction and over an entire length of the first rod-like portion, and wherein the cavity has one end being open to an outside at an opening portion formed at a distal end of the tip and another end closed by the second rod-like portion inserted into a fitting hole of the coupling portion.

2. The drumstick for a performance according to claim 1, wherein the cavity defined in the first rod-like portion has a uniform inner diameter from the opening portion to the fitting hole.

3. The drumstick for a performance according to claim 1, wherein the cavity defined in the first rod-like portion includes:

an inlet cavity portion extending from the opening portion to the shoulder; and a resonance cavity portion, which communicates with the inlet cavity portion, and has an inner diameter larger than an inner diameter of the inlet cavity portion, and wherein the inlet cavity portion has a tapered shape that is gradually increased in inner diameter as extending toward the opening portion, and the resonance cavity portion has a tapered shape that is gradually increased in inner diameter as extending toward the fitting hole.

4. The drumstick for a performance according to claim 1, wherein the first rod-like portion has, on a rear end side thereof, a reinforcement groove extending in the axial direction of the first rod-like portion.

5. The drumstick for a performance according to claim 1, wherein the second rod-like portion includes:

a grip made of a synthetic resin; and an intermediate rod-like portion, which is made of wood, and is configured to couple the grip and the first rod-like portion to each other.

6. The drumstick for a performance according to claim 1, wherein the tip has, on an outer peripheral surface thereof, a plurality of dimples.

* * * * *